United States Patent [19]

Sirois

[11] Patent Number: 4,875,430

[45] Date of Patent: Oct. 24, 1989

[54] BOAT BUILDING METHOD USING MODULAR PROPULSION SYSTEM

[75] Inventor: William L. Sirois, Pembroke Park, Fla.

[73] Assignee: Copeland-Sirois Enterprises, Inc., Jefferson, La.

[21] Appl. No.: 183,235

[22] Filed: Apr. 19, 1988

[51] Int. Cl.[4] ..... B63H 23/08

[52] U.S. Cl. ..... 114/355; 20/527.2; 440/83; 440/112

[58] Field of Search ..... 440/50, 51, 52, 57, 440/82, 83, 111, 112, 79, 56; 114/355, 356, 357; 29/404, 527.2, 426.1

[56] References Cited

U.S. PATENT DOCUMENTS 2,022,652 12/1935 Fahrney et al. ..... 440/112

2,595,863 5/1952 Loofbourrow ..... 440/112

*Primary Examiner*—Joseph F. Peters, Jr.

*Assistant Examiner*—Edwin L. Swinehart

*Attorney, Agent, or Firm*—Larson and Taylor

[57] ABSTRACT

A method is provided for constructing an engine-powered propeller-driven boat. The method involves first pre-assembling a propulsion system, comprising a plurality of separate pre-machined components such as a propeller shaft, a shaft support strut, and a thrust bearing assembly, on a main casting in a manner so as to assure proper fit and alignment of the components. The components are then disassembled from the casting, and the main casting is mounted on a hull mold in a predetermined position. The hull is then formed by laying up laminations within the hull mold around and over the main casting such that the main casting is made integral with the hull. Thereafter, the components of the propulsion system are re-assembled on the integral main casting so that the components, which now fully aligned, become part of the boat. The thrust bearing assembly includes a main housing which is isolated by a rubber laminate from the bearing housing so as to eliminate propeller shaft vibrations. A universal joint assembly connected between the thrust bearing assembly and the engine takes up any misalignment of the engine.

16 Claims, 4 Drawing Sheets

BOAT BUILDING METHOD USING MODULAR PROPULSION SYSTEM

FIELD OF THE INVENTION

The present invention relates to inboard powered boats and other water craft and more specifically, to an improved method of constructing such boats particularly with respect to installation of the propulsion system, to an assembly used in that method, and to a boat constructed using that method.

BACKGROUND OF THE INVENTION

The installation of a conventional propulsion system in an inboard motor or engine powered water craft is a source of many problems. For example, the task is very time consuming and requires relatively highly skilled labor, and, even where considerable care is taken, the finished product often suffers mechanical problems, particularly with respect to the alignment provided between the various components including the engine, propeller shaft, and shaft bearing.

One approach to solving this problem involves the use of integrated propulsion and steering units, and a number of different propulsion and steering assemblies have been developed wherein the basic components are formed as a one-piece or integrated unit in order to eliminate alignment problems associated with prior art assemblies that arise when the different components are assembled together during manufacture or outfitting of the basic boat. Reference is made, for example, to U.S. Pat. No. 3,003,458 (Starns, Jr.) wherein an inboard boat propulsion and steering assembly is disclosed which includes a propeller shaft "log" or housing, a mounting plate, a rudder shaft "log" or housing and a downwardly depending shaft support strut carrying a propeller shaft bearing, all formed as an integral unit. It will be appreciated that this integral unit inherently provides proper alignment between the propeller shaft log and the propeller shaft bearing. The integral unit, with the propeller shaft and rudder inserted therein, can be installed as one piece, and when the unit is installed, only installation, alignment and connection of the engine and mounting of the propeller on the propeller shaft remain in order to complete the propulsion and steering assembly. Other examples of integrated units of this general type include U.S. Pat. Nos. 2,064,463 (Crosley, Jr.); 2,630,094 (Hacker); 2,895,446 (Upton); 2,934,034 (Grzesnikowski); 4,040,378 (Blanchard); 4,046,096 (Liaaen); and 4,236,478 (Mansson). One serious disadvantage of such units is that when damage occurs the entire unit generally must be replaced.

SUMMARY OF THE INVENTION

In accordance with the invention, an improved method is provided for constructing a boat which substantially simplifies installation of a basic inboard propulsion unit for the installer at the site wherein the boat is manufactured, without using a one piece integrated unit. In addition, as a result of this method, the quality and alignment of the installation is maintained by virtue of the fact that the propulsion and steering components including, for example, the rudder, propeller shaft, propeller shaft support strut, thrust bearing assembly and water pick-up, while initially separate components, are all integrated into a single modular unit or assembly in combination with, and mounted on, a main casting member. Thus, the method of the invention provides some of the same basic advantages associated with "pre-integrated" one piece units while not requiring the use of such a unit.

Generally speaking, the method of the invention initially involves mounting of the individual components of propulsion and steering system, after pre-machining thereof, in a main casting, preferably using registering locator pins and holes to check for and maintain proper fit and alignment. After this step is completed and perfect alignment is ensured, the components are disassembled from the main casting and the main casting is installed in a mold for making the hull of the boat in a predetermined position therein, preferably using locator pins to ensure consistency in location from boat to boat. With the main casting in place, lamination of the hull is carried out with layup of laminations around and over the main casting so that main casting is incorporated into, and becomes a permanent part of, the finished boat. After the hull layup is completed, the hull is removed from the mold and the components of the propulsion and steering system are re-assembled on the main casting, preferably using cooperating locator pins and holes to ensure that all of the components are positioned as before in order to maintain proper alignment.

A key advantage of the method of the invention is that re-assembly of the components of the propulsion system can be completed by an unskilled laborer in what is, relatively speaking, a very short period of time. In this regard, it has been found that the time and cost involved in a typical case is approximately one-tenth that required using conventional techniques. Moreover, and very importantly, the method of the invention still maintains perfect alignment. Further, it is noted that the inherent stiffness of the resultant assembly ensures that shaft alignment will not change as the laminated hull continues to cure. This is to be contrasted with standard inboard installations wherein distortion and misalignment are common occurrences.

A further important advantage of the modular construction of the invention as compared with, for example, integral propulsion units, is that pre-machined replacement components are much easier and less costly to replace when damaged in use (e.g., by hitting a submerged object or when the boat runs aground).

In addition to the foregoing, there are a number of further aspects or features of the invention which contribute to maintaining proper alignment or which provide other advantages. For example, the thrust bearing assembly employed reduces or eliminates of propeller and shaft vibrations through the provision of isolating means, preferably in the form of a layer of rubber or other resilient material, between the main housing of the thrust bearing assembly and an internal housing for the bearing unit.

In addition, according to a further aspect of the invention, the thrust bearing housing is directly connected to the main casting (e.g., in an advantageous embodiment through the use of a plurality of mounting studs) so that all thrust is directed from the thrust bearing assembly into the boat hull through the main casting, thereby eliminating the need for perfectly aligned companion flanges on the propeller shaft and engine transmission.

Further, in accordance with yet another important aspect of the invention, a universal joint assembly is connected between the thrust bearing assembly and the engine, typically between the companion flanges referred to above, so as to take up any misalignment of the engine and so as to permit the engine to be mounted on softer durometer resilient (e.g., rubber) mounts. This feature of the invention substantially reduces or eliminates engine vibrations from being transferred to the hull structure. In conventional constructions, harder durometer mounts are required to maintain flange alignment and this results in the introduction of harmonic vibrations into the hull.

A further important feature of the invention involves the provision of a recessed pocket, cast into the main casting, for supporting the base of the propeller support strut. This pocket eliminates the water turbulence in and around the strut base such as occurs in standard installations.

As stated above, the housing for the thrust bearing assembly is directly mounted on, i.e., connected to, the main housing and, according to a further significant feature of the invention, the portion of the casting against which the bearing housing mounts is of sufficient thickness to allow machining to different dimensions in order to change the propeller shaft angle and to allow different strut drop dimensions to be used. As discussed below, the thrust bearing assembly can be mounted either internally or externally depending on the particular installation configuration desired.

Other features and advantages of the invention will be set forth in, or apparent from, the detailed description of preferred embodiments of the invention which follows.

DESCRIPTION OF THE PREFERRED EMBODIMENTS

Figure 1:
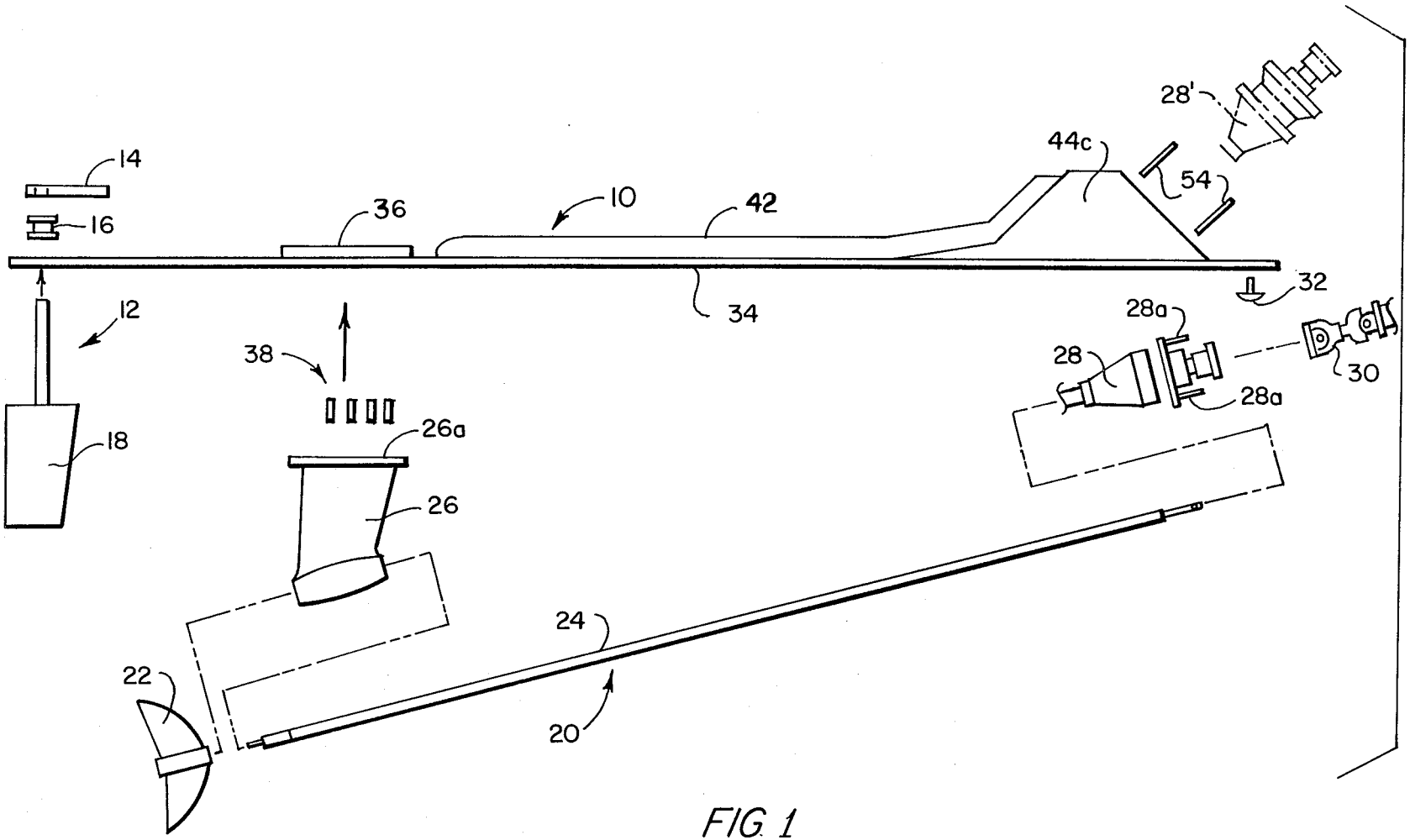
FIG. 1 is an exploded side elevational view of a propulsion and steering assembly in accordance with a preferred embodiment of the invention.
Figure 2:
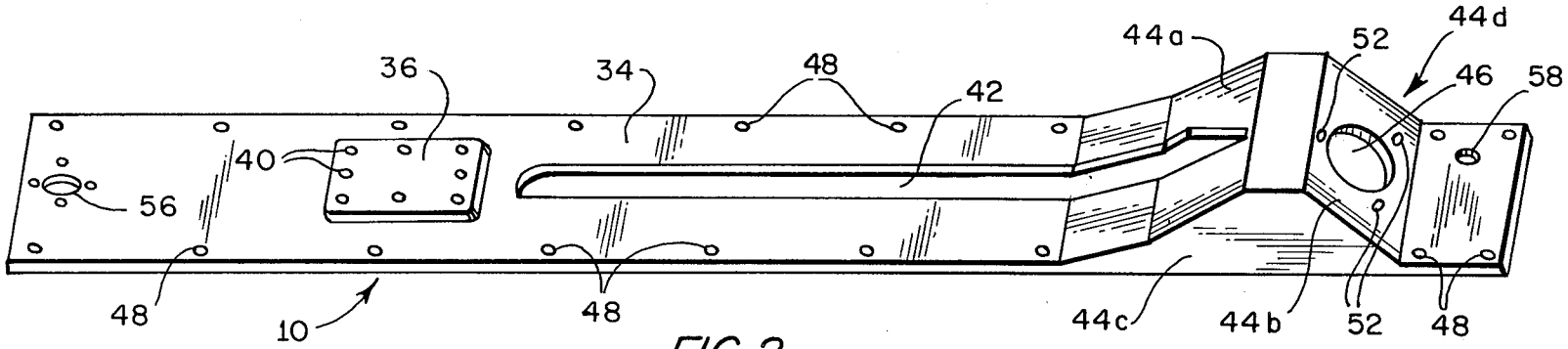
FIGS. 2 and 3 are top and bottom perspective views of the main casting of FIG. 1.
Figure 3:
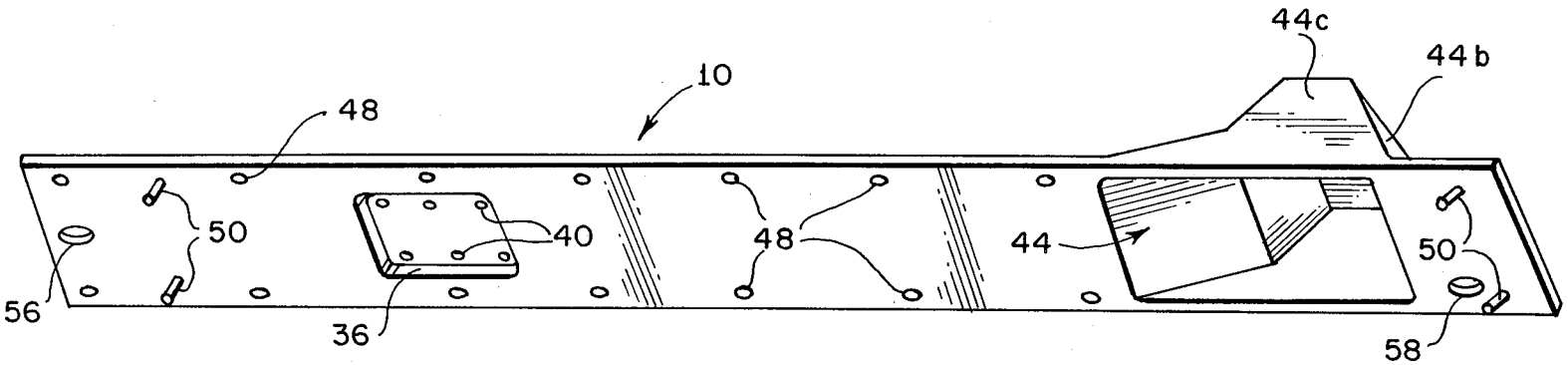
Figure 4:
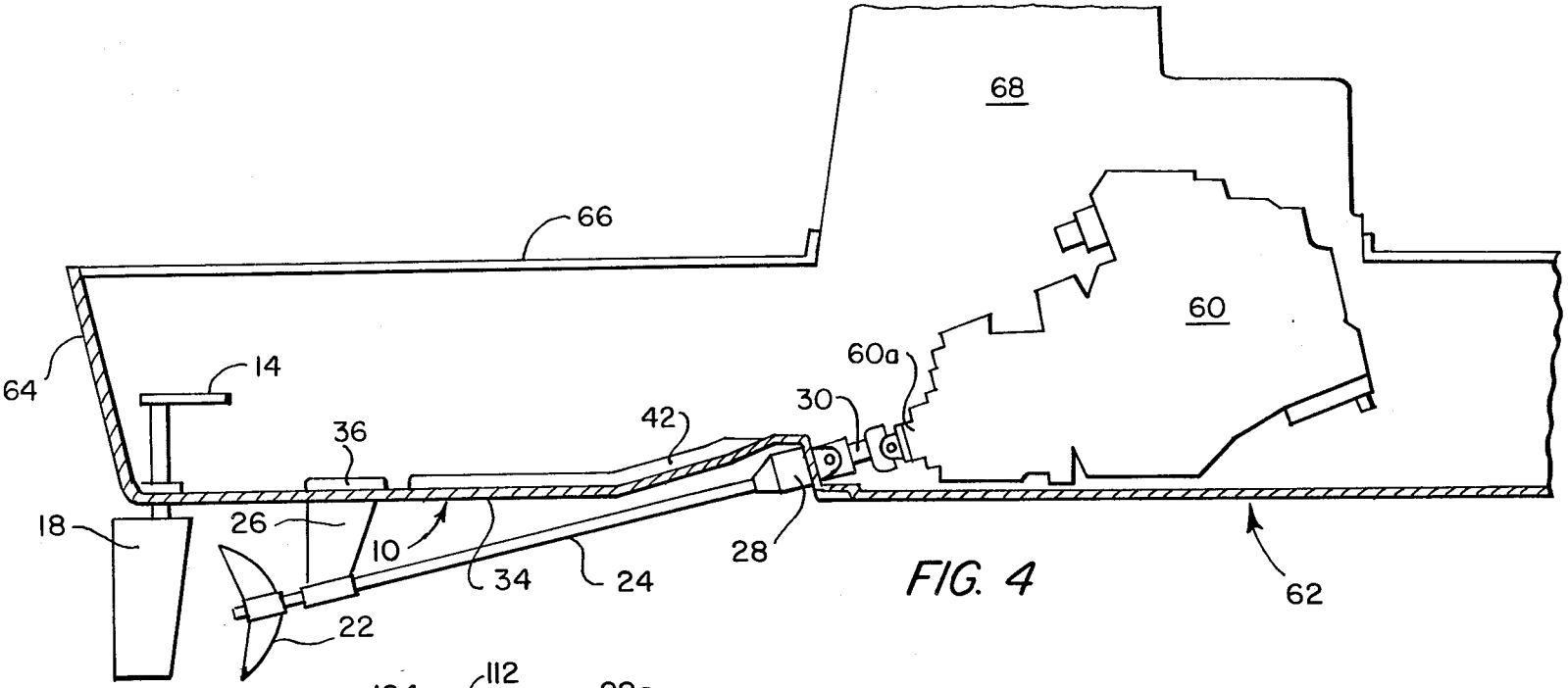
FIG. 4 is a side elevational view, partially in section, of the assembly of FIGS. 1 to 3, as incorporated, together with a universal joint assembly, in an inboard power boat.

Referring to FIG. 1, an exploded view is provided of the modular drive construction of the present invention. The modular components include a main casting 10, which is also shown in FIGS. 2 and 3, a rudder assembly 12 including a tiller arm 14, a rudder port or coupling 16, and a rudder 18, a propeller drive assembly 20 including a propeller 22, a propeller shaft 24, a support strut 26, an external thrust housing 28 (shown in detail in FIG. 5), a universal joint (U-joint) assembly 30 (also shown in detail in FIG. 5) adapted to be connected to the engine drive shaft (not shown in FIG. 1), and a water pickup 32. It is noted that in an alternative embodiment, an internal thrust housing (i.e., internal to the boat), can also be used as indicated in dashed lines at 28'. The modular drive construction, as assembled, is shown in FIG. 4, and it will be appreciated that other connecting nuts and washers are used in assembling the modular construction (e.g., for connecting propeller 22 to propeller shaft 24) which have not been specifically identified.

Referring to FIGS. 1 to 3, as illustrated in these FIGS., the main casting 10 comprises an elongate generally flat body portion 34 having integrally formed therein a relatively shallow, generally rectangular strut pocket 36 which receives the base plate **26*a* of strut 26. Dowel pins 38 (FIG. 1) fit into corresponding holes 40 (FIGS. 2 and 3) in strut pocket 36** to provide proper alignment.

Main casting 10 further includes a centrally located, longitudinally extending reinforcing rib 42 over a major portion of the length thereof. Rib 42 extends up a portion of the rear wall **44*a* of a thrust "pocket" or housing 44 for, in a first embodiment, receiving the thrust bearing housing of the drive system. As illustrated, the rear wall 44*a* of thrust pocket 44 includes a first relatively gently inclined portion and a more steeply inclined portion, while the flat front wall 44*b* of thrust pocket 44 is relatively steeply inclined and includes an aperture 46 therein through which the drive system extends. Thrust pocket 44 also includes flat side walls 44*c* and 44*d***.

Main casting 10 further includes a series of holes 48 arranged in rows along both edges thereof as shown in FIGS. 2 and 3. These holes 48 are adapted to receive registering pins 50 therein for the mold described below. Further apertures 52 (FIG. 2) in the front wall **44*b* of thrust housing 44 are adapted to receive connection pins or studs 54 (FIG. 1) which are used to mount thrust housing 28, in place in the alternative embodiment referred to above or to receive the mounting studs 28*a* of thrust housing 28. An aperture 56 at the rear or aft end of body portion 36 of main casting 10 serves as a rudder through port for tiller assembly 12 while a laterally offset aperture 58 at the front or forward end of portion 36 serves as water pickup port for water pickup device 32**.

As mentioned above, the drive system is shown in place on a boat in FIG. 4, with the U-joint assembly 30 connected to the drive shaft **60*a* of an engine 60. The boat, which is generally denoted 62, includes a transom 64, a cockpit 66 and a console 68** although it will, of course, be appreciated that the present invention can be adapted to other propeller driven boats, and other water craft, of many different designs.

Figure 5:
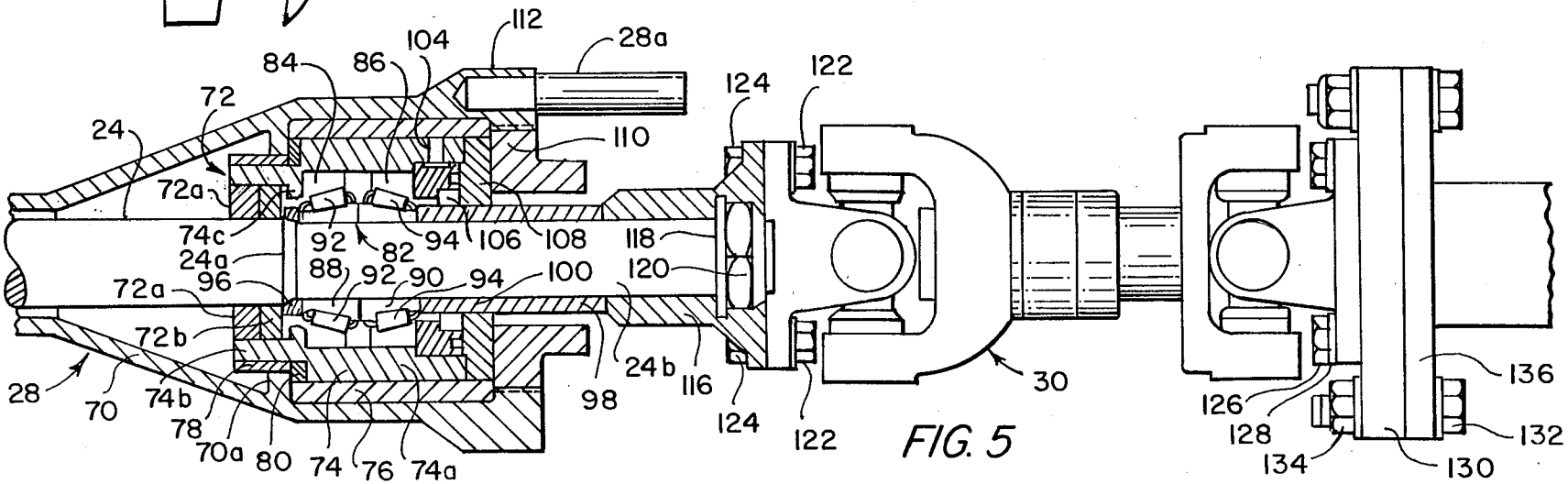
FIG. 5 is a side elevational view, partially in cross section, of the thrust bearing assembly of FIGS. 1 to 4 and the universal joint assembly of FIG. 4.

Referring to FIG. 5, a side elevational view, partially in cross-section, is provided of the thrust bearing assembly 28 and the universal joint assembly 30. Thrust bearing assembly 28 includes a main housing 70 through which the propeller shaft 24 extends. A rear seal assembly 72 comprising a pair of seals **72*a*, 72*b* is disposed between propeller shaft 24 and a thrust bearing housing 74. A radial rubber cushion 76 is disposed between the main body of bearing housing 74 and main housing 70 while a further radial rubber cushion 78 is disposed between an inwardly directed flange 70*a* of main housing 70 and a reduced diameter portion 74*b* of bearing housing 74. A rubber thrust ring 80 is disposed axially between flange 70*a* and the main diameter portion 74*a* of bearing housing 74**.

A thrust bearing unit 82 is captured within bearing housing 74 and includes a pair of axially spaced outer bearing supports or races 84 and 86, a pair of inner bearing supports or races 88 and 90 and two sets of tapered roller bearings 92 and 94.

As illustrated, propeller shaft 24 necks down at the front end thereof and a shoulder **24*a*, located between the main shaft 24 and a reduced diameter portion 24***b*, is engaged by a shaft thrust ring 96 also in axial abutment with inner bearing support 88. The other inner bearing support 90 engages an annulus spacer member 98 which carries an 0-ring shaft seal 100.

Outer bearing support 84 engages and abuts an inwardly extending flange 74*c* of bearing housing 74 while outer bearing support member 86 engages and abuts an inner thrust cap 102 which is secured to bearing housing 74 by a set screw 104. A further seal 106 is disposed between a stepped inner surface of thrust cap 102 and space 98, and a further rubber thrust ring 108 is disposed between thrust cap 102 and one end of bearing housing 74, on the one hand, and an outer thrust cap 110, on the other. Outer thrust cap 110 is screwed on the wide diameter, open front end of main housing 70 and is arranged in spaced relation to spacer 98.

A series of bores, one of which, denoted 112, is shown, is provided in the front end surface of main housing 70 and these bores are each adapted to receive an associated mounting stud 28*a* (see also FIG. 1). In the exemplary embodiment being considered, three such mounting studs 28*a* (two of which are shown in FIG. 1) are employed in cooperation with apertures 52 in mounting main housing 70 in place in pocket 44 of main casting member 10.

A companion flanqe 116 engages a washer 118 and a nut 120 provided on the front end of the reduced diameter portion 24*b* of propeller shaft 24. Flange 116 is bolted to universal joint or slip joint 30 by mounting bolts 122 and associated nuts 124 and thus serves to mount universal joint 30 onto the end of propeller shaft 24. Universal joint 30 is an entirely conventional, off the shelf component and further description thereof is not seen to be necessary. As illustrated, the other end of universal joint 30 is connected by mounting bolts 126 and washers 128 to an adapter ring 130 which is connected by bolts 132 and nuts 134 to a reference transmission flange 136 associated with engine 60.

Considering the operation of the thrust bearing arrangement of FIG. 5 (in conjunction with FIG. 4), when the engine 60 is operating, in forward gear, and throttle is applied, a thrust path is provided as will now be described. Thrust is initially transferred from the propeller 22 to the propeller shaft 24 by a standard woodruff key and keyway arrangement (not shown) at the aft end. The stepping down of propeller shaft at 24*a* inside of housing 70 permits use of thrust ring 96 so as to provide better contact between shaft 24 and the inner race 88 of bearing unit 82. Because the inner races 88 and 90 are in contact, thrust is exerted through these races and into the forward other, race 84 through tapered rollers 94. As set forth above, the forward outer race 86 is in contact with inner thrust cap 102 which is threaded into the end of bearing housing 74. This effectively makes bearing housing 74 a thrust unit unto itself.

Continuing the description of the thrust path, thrust is transferred to outer thrust cap 110 by means of rubber thrust ring 108. Because, as described above, thrust cap 110 is threaded into the end of main housing 70, main housing 70 is also effectively a thrust unit itself. Thrust is then transferred to the hull of the boat because main housing 70 of thrust bearing assembly 28 is connected to the main casting 10 by mounting studs 28a and the main casting is molded and through-bolted into the hull itself.

The bearing preload can be set by varying torque on the inner thrust cap 102 and observing the axial force (in inches per pound) on the propeller shaft 24. Bearing preload adjustment is maintained by locking inner thrust cap 102 with set screw 104 after the preload is adjusted. The assembly of the thrust bearing system is completed by tightening forward shaft nut 120 to bear on washer 118, companion flange 116 and spacer 100.

It is to be noted the bearing housing assembly 74 is resiliently isolated, by the various rubber components described above, from the main housing 70, thereby eliminating both thrust and radial vibrations. In addition, the bearing housing 74 is prevented from rotating (radially) within the main housing 70 by providing a octagonal shape (not shown) in the area of the two rear lip seals 72*a* and 72*b* and isolated in this area from the main housing 70 by rubber radial cushion 78. A predetermined quantity of lubricant is confined with the bearing housing 74 by the rear lip seals 72*a*, 72*b*, the forward 0-ring seal 100 and the forward seal 106.

Figure 6:
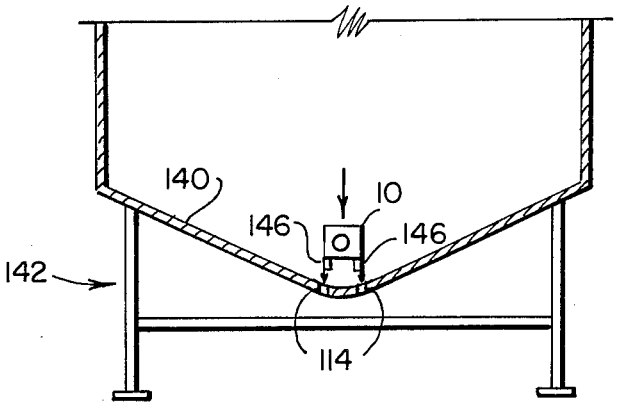
FIGS. 6 to 8 are front elevational views, partially in cross section, of a hull mold showing three basic steps, in accordance with the invention, used in constructing the boat of FIG. 5.
Figure 7:
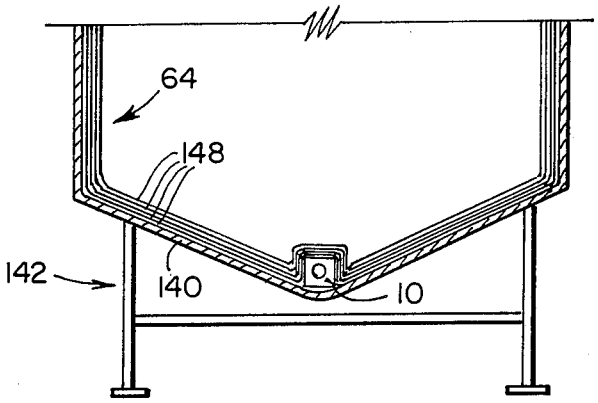
Figure 8:
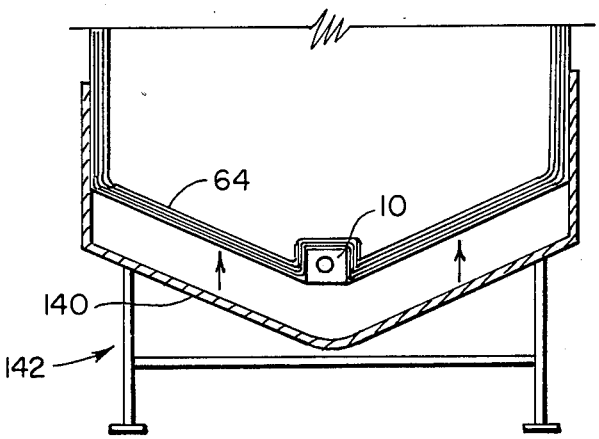

Considering the steps in the construction or fabrication of a boat incorporating the modular propulsion and steering system of the invention and referring in particular to FIGS. 6, 7 and 8, and initially to FIG. 6, main casting 10 is, as an initial step in the actual molding process, placed onto a hull mold 140 used in molding the hull of a boat such as that illustrated in FIG. 4. Prior to this, the various components shown in FIG. 1 (and in FIG. 4) are pre-machined and mounted on registering pins in the main casting 10 to check for proper fit and alignment After this check is completed, these components will all be disassembled leaving only the main casting 10. The mold 140 is supported by a support frame 142 in a conventional manner and is provided with locating holes 144 which cooperate with locating pins 146 (corresponding to those denoted 50 in FIG. 1) received in corresponding locating holes 48 (FIG. 1) in main casting 10 to provide proper registration between the mold 140 and the main casting 10.

Referring to FIG. 7, laminations, indicated at 148, are then laid out over the main casting 10 and hull mold 140. The lamination process employs four to five layers of standard hull laminations, cloth and resin, and is entirely conventional. After the lamination process is completed, the completed hull, corresponding to that denoted 64 as in FIG. 4, is lifted out of the mold 140, with inserted casting 10 incorporated therein as an integral part of the hull.

As a final step, the parts shown in FIG. 1 are reassembled together as shown in FIG. 4 with locating pins such as those indicated at 26a in FIG. 1 being used in cooperation with the locating holes 40 of strut pocket 40 to locate the support strut 26 in place within strut pocket 40. It will be understood that with the aid of the locating pins, this re-assembly can be completed using a small fraction of time, and at a small fraction of the cost, that would normally be required, but while still maintaining perfect alignment.

Although the present invention has been described relative to exemplary embodiments thereof, it will be understood by those skilled in the art that variations and modifications can be effected in these exemplary embodiments without departing from the scope and spirit of the invention.

I claim:

1. A method for constructing an engine-powered propeller-driven water craft, said method comprising the steps of:

(i) pre-assembling a propulsion system, comprising a plurality of separate pre-machined components including a propeller shaft, a support strut for supporting the propeller shaft connected to the propeller shaft at one end thereof, and a thrust bearing assembly connected to the other end of the propeller shaft, on a main casting in a manner so as to assure proper fit and alignment of said components;

(ii) disassembling said components from said main casting;

(iii) mounting said main casting on a hull mold in a predetermined position in relation to the hull mold;

(iv) forming the hull of the water craft by laying up laminations within the hull mold around and over the main casting such that the main casting is made integral with the hull so formed; and (v) re-assembling the components of the propulsion system on the main casting integral with the hull in the previous positions thereof so as to ensure proper alignment and so that the components then become part of the craft.

2. A method as claimed in claim 1 wherein said components are assembled on said main casting using locating pins so as to fix the aligned relationship between the components and the main casting.

3. A method as claimed in claim 1 wherein mounting of said main casting on said hull mold in a predetermined position is accomplished using cooperating holes and locating pins in positioning said main casting on said mold.

4. A method as claimed in claim 1 wherein said main casting includes a pocket therein and a base portion of said support strut is mounted in said pocket.

5. A method as claimed in claim 1 wherein said main casting includes a pocket therein formed in part by an inclined wall including an aperture therein, and wherein said propeller shaft is mounted so as to extend through said aperture and said thrust bearing assembly is connected to said inclined wall.

6. A method as claimed in claim 5 wherein said main casting includes a further pocket therein spaced from the aforementioned pocket and a base portion of said support strut is mounted in said further pocket.

7. A method as claimed in claim 1 further comprising connecting an engine for powering the craft to the thrust bearing assembly through a universal joint assembly so as to take up any misalignment of the engine.

8. A method as claimed in claim 7 further comprising mounting the engine for powering the craft on relatively soft durometer rubber mounts.

9. An assembly for use in constructing an engine-powered propeller-driven water craft, said assembly comprising:

a propeller shaft;

a support strut, including a base, for supporting said propeller shaft; and a main casting, adapted to be integrally incorporated in the hull of a water craft, comprising an elongate substantially flat base portion, a first recessed pocket formed in said base portion having an aperture therein through which said propeller shaft extends; a further recessed pocket formed in said base portion for receiving the base of said support strut therein, and a thrust bearing assembly connected to said propeller shaft and disposed wholly within said first pocket so to be located above the keel line of the water craft in which the main casting is adapted to be incorporated and connected to said first pocket so that thrust is transmitted through the main casting to the hull of the water craft in which the main casting is incorporated.

10. An assembly as claimed in claim 9 comprising a plurality of mounting studs for connecting the thrust bearing assembly to said main casting.

11. An assembly as claimed in claim 9 further comprising a universal bearing assembly for connecting thrust bearing assembly to an engine for powering the propeller shaft.

12. A boat or other water craft comprising:

a hull;

an engine for powering the boat;

a plurality of resilient, relatively soft rubber engine mounts for mounting said engine within said hull;

a propeller shaft;

a thrust bearing assembly connected to one end of said propeller shaft;

a universal joint assembly for connecting said thrust bearing assembly to said engine;

a main casting fixedly and nonremovably incorporated in a bottom portion of said hull as an integral part of said boat, said main casting including a first recessed pocket formed therein through which said propeller shaft extends and to which said thrust bearing assembly is connected and a second recessed pocket spaced from said first pocket; and a propeller shaft support strut, connected to said main casting and having a base portion received in said second pocket, for supporting said propeller shaft.

13. A boat as claimed in claim 12 wherein said thrust bearing assembly is disposed wholly within said first pocket, said first pocket including an inclined wall portion having an aperture therein through which propeller shaft extends.

14. A boat as claimed in claim 13 wherein said thrust bearing assembly includes a plurality of mounting studs connecting said bearing assembly to said inclined wall portion of the first pocket of the main casting so that thrust is transmitted through the main casting to the hull.

15. A boat as claimed in claim 12 wherein said thrust bearing assembly includes a main housing, a bearing housing, a roller bearing unit disposed within said bearing housing, and a resilient means disposed between said main housing and said bearing housing for isolating said bearing housing from said main housing so as to reduce or eliminate thrust and radial vibrations.

16. An assembly for use in constructing engine-powered propeller-driven water craft, said assembly comprising:

a propeller shaft;

a support strut, including a base, for supporting said propeller shaft;

a main casting, adapted to be integrally incorporated in the hull of a water craft, comprising an elongate substantially flat base portion, a first pocket formed in said base portion having an aperture therein through which said propeller shaft extends; a further pocket formed in said base portion for receiving the base of said support strut therein; and a thrust bearing assembly connected to said propeller shaft, said thrust bearing assembly comprising a main housing, a further bearing housing disposed within said main housing, a bearing unit supported within said further bearing housing, and resilient means disposed between said housings for isolating said further housing from said main housing so as to reduce or eliminate thrust and radial vibrations.

* * * * *